US005982060A

United States Patent [19]

Hakala et al.

[11] Patent Number: 5,982,060

[45] **Date of Patent: *Nov. 9, 1999**

[54] ELEVATOR MACHINERY

[75] Inventors: Harri Hakala; Jorma Mustalahti, both of Hyvinkää; Esko Aulanko, Kerava, all of Finland

[73] Assignee: Kone Oy, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,383

[22] PCT Filed: Mar. 24, 1995

[86] PCT No.: PCT/FI95/00159

§ 371 Date: Nov. 12, 1996

§ 102(e) Date: Nov. 12, 1996

[87] PCT Pub. No.: WO95/28028

PCT Pub. Date: Oct. 19, 1995

[30] Foreign Application Priority Data

Apr. 7, 1994 [FI] Finland ..... 941599

[51] Int. Cl.[6] ..... H02K 1/22

[52] U.S. Cl. ..... 310/67 R; 310/268; 310/261; 310/254; 187/250; 187/254; 187/277

[58] Field of Search ..... 310/77, 76, 67 R, 310/268, 254, 261; 187/250, 254, 277

[56] References Cited

U.S. PATENT DOCUMENTS

| | | | |
|---|---|---|---|
| 2,088,690 | 8/1937 | Crispen | 187/254 |
| 3,101,130 | 8/1963 | Bianca | 187/244 |
| 3,500,083 | 3/1970 | Dochterman | 310/51 |
| 3,619,676 | 11/1971 | Kawakami et al. | 310/112 |
| 4,361,776 | 11/1982 | Hayashi et al. | 310/268 |
| 4,664,230 | 5/1987 | Olsen | 187/39 |
| 4,739,969 | 4/1988 | Eckersley et al. | 254/378 |
| 4,771,197 | 9/1988 | Ivanto et al. | 310/67 R |
| 4,814,654 | 3/1989 | Gerfast | 310/154 |
| 4,823,039 | 4/1989 | Lynch | 310/268 |
| 4,960,186 | 10/1990 | Honda | 187/20 |
| 4,978,878 | 12/1990 | Dijken | 310/268 |
| 5,018,603 | 5/1991 | Ito | 187/17 |
| 5,024,162 | 6/1991 | Nigg et al. | 104/178 |
| 5,062,501 | 11/1991 | Pavoz et al. | 187/112 |
| 5,079,461 | 1/1992 | Schluter et al. | 310/67 A |
| 5,128,571 | 7/1992 | Itsu | 310/67 R |
| 5,140,212 | 8/1992 | Iwasaki et al. | 310/191 |
| 5,142,181 | 8/1992 | Newell | 310/268 |
| 5,144,183 | 9/1992 | Farrenkopf | 310/268 |
| 5,146,144 | 9/1992 | Lee | 318/138 |
| 5,334,899 | 8/1994 | Skybyk | 310/268 |
| 5,396,134 | 3/1995 | Mochizuki | 310/67 R |
| 5,397,953 | 3/1995 | Cho | 310/254 |
| 5,440,185 | 8/1995 | Allwine, Jr. | 310/156 |
| 5,455,474 | 10/1995 | Flynn | 310/181 |
| 5,475,274 | 12/1995 | Katakura | 310/67 R |
| 5,493,161 | 2/1996 | Uno et al. | 310/156 |
| 5,495,131 | 2/1996 | Goldie et al. | 310/12 |
| 5,589,722 | 12/1996 | Sakaguchi et al. | 310/180 |

FOREIGN PATENT DOCUMENTS

| | | | |
|---|---|---|---|
| 2127873 | 7/1993 | Canada | H02K 1/06 |
| 1171571 | 12/1989 | Japan . | |
| 262394 | 3/1990 | Japan . | |
| 556618 | 3/1993 | Japan . | |
| 578184 | 10/1993 | Japan . | |
| 1485305 | 9/1977 | United Kingdom . | |

*Primary Examiner*—Nestor Ramirez
*Assistant Examiner*—B. Mullins

[57] ABSTRACT

The stator disc (18) of the motor (2) of a disc motor type elevator machinery is s provided with an annular cavity (19*a*) in which the stator (9) is placed. The stator (9) is attached to one of the walls of the cavity. The rotor (13) is placed in a rotor disc (12). Between at least one (28*a*) of the walls of the cavity (19*a*) and the rotor disc (12) there is a sealing (26*a*) which seals the cavity so as to render it a closed space. The sealing blocks the entry of external particles into the rotor and stator.

38 Claims, 3 Drawing Sheets

ELEVATOR MACHINERY

Figure 1:
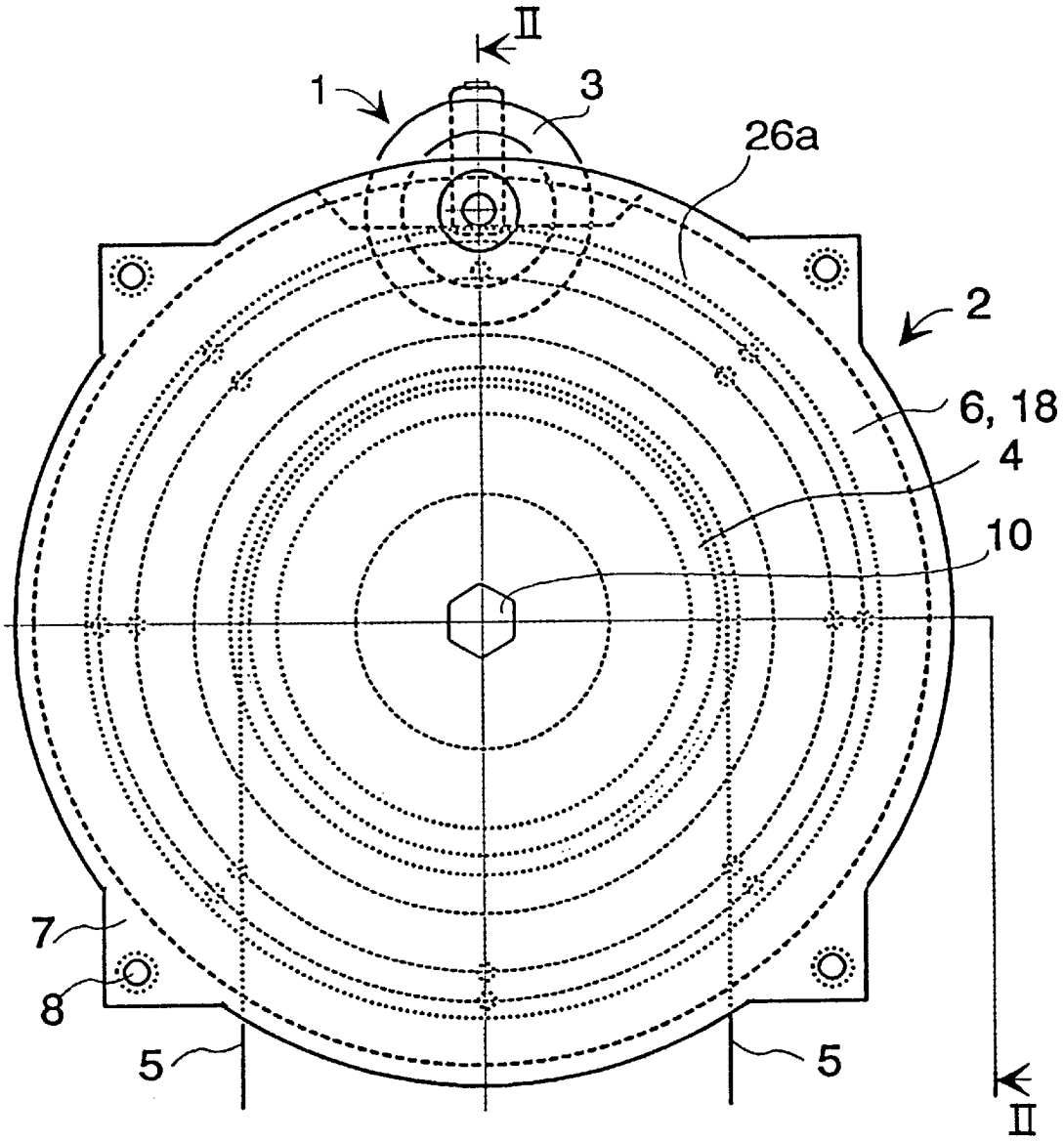

The present invention relates to an elevator motor and to an elevator machinery in which the stator disc includes a generally annular cavity, an open side of which is directed toward the rotor disc, and an annular sealing is provided between the rotor disc and a wall of the cavity.

The physical dimensions of an elevator machinery affect the size of the elevator shaft and/or the building itself, depending on where the machinery is located. When the machinery is placed in or beside the elevator shaft or in a machine room, the thickness of the machinery is of essential importance with respect to the space required.

An elevator machinery can also be implemented using a disc-type motor, e.g. like the elevator motor presented in FIG. 8 of patent publication U.S. Pat. No. 5,018,603. The motors described in this publication are clearly more compact and flatter in the lengthwise direction of the motor shaft than conventional geared elevator machineries. However, the machineries presented in the publication are clearly designed for installation in a machine room. The rotor structure in these elevator machineries consists of a separate iron packet attached to the rotor disc, the windings being placed in the iron packet.

Previously known elevator machineries using a disc-type motor have the drawback that detrimental particles, such as ferromagnetic dust, may gather from the air in the space of the stator and rotor windings.

The object of the present invention is to produce a new solution for a disc-type motor of an elevator machinery, designed to prevent detrimental particles from getting into the winding space of the motor. A further object of the invention is to produce a new type of elevator machinery, in which an elevator motor as provided by the invention is integrated with the elevator machinery so as to form a single part with it.

The invention provides a way to block the entry of detrimental particles into the winding space of a disc-type elevator motor, thus ensuring that the winding space remains clean and permitting longer maintenance intervals of the motor.

The elevator motor of the invention uses a simple sealing structure. The stator disc can be provided with an integrated sealing area during manufacture, thereby reducing the manufacturing costs. The sealing can be implemented using any of the commonest seal types based on a sliding sealing function, such as a felt seal, a lap seal or a brush seal. It is also possible to use labyrinth or combination sealing. Providing an elevator motor with a sealing as provided by the invention is useful in all disc-type elevator motors and very useful in elevator motors in which rotor excitation is implemented using permanent magnets attached to the rotor disc.

In the elevator machinery of the invention, the elevator motor is integrated as a part of the elevator machinery so as to produce a very flat and compact machinery. Actually one cannot directly tell which part of the assembly belongs to the elevator machinery and which part belongs to the elevator motor, because in fact the elevator machinery is built around the elevator motor. The elevator machinery is suited for installation in a machine room, in the counterweight of the elevator or in the elevator shaft.

The invention is described by the aid of two embodiments, in which

Figure 2:
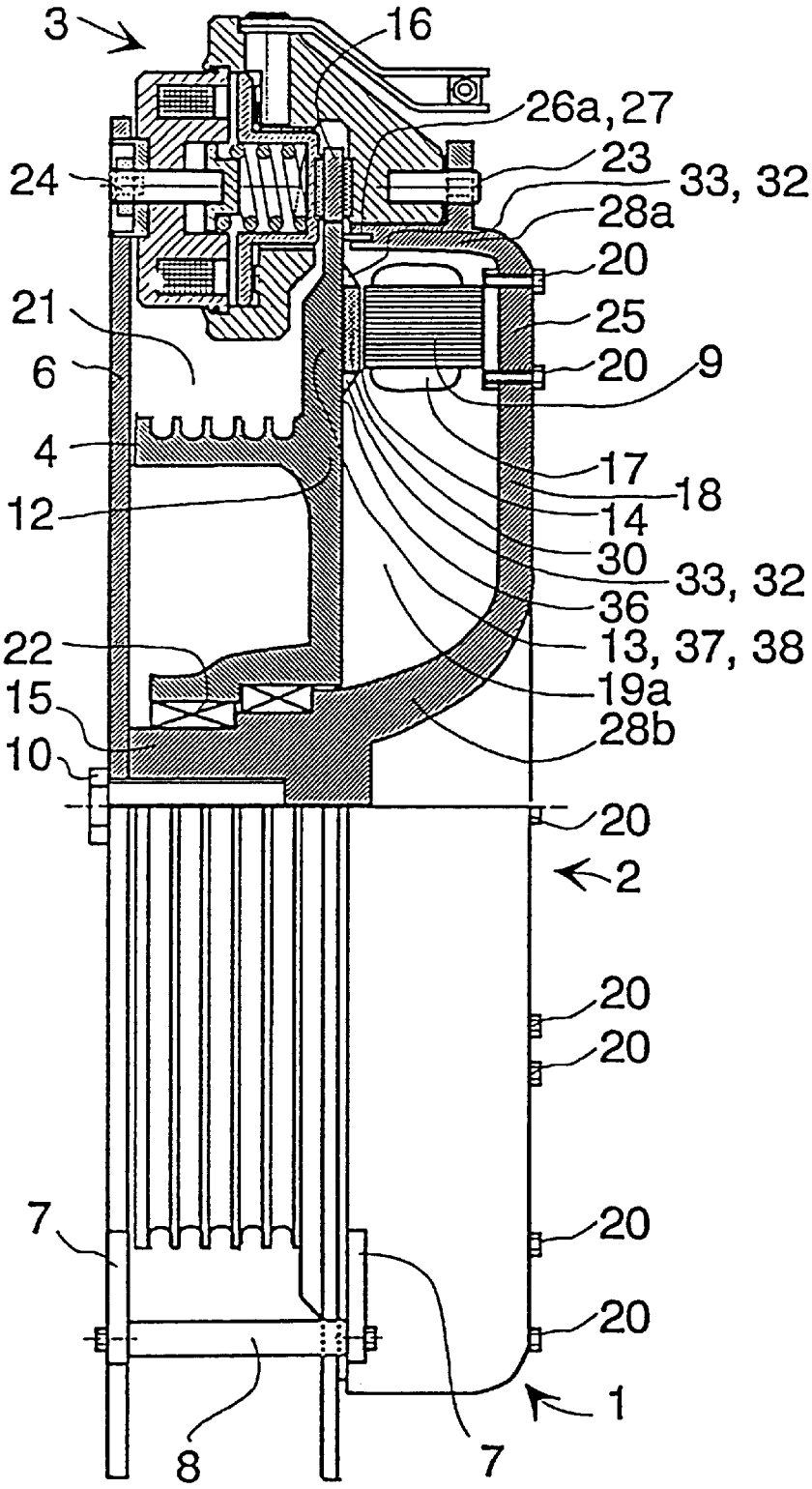
Figure 3:
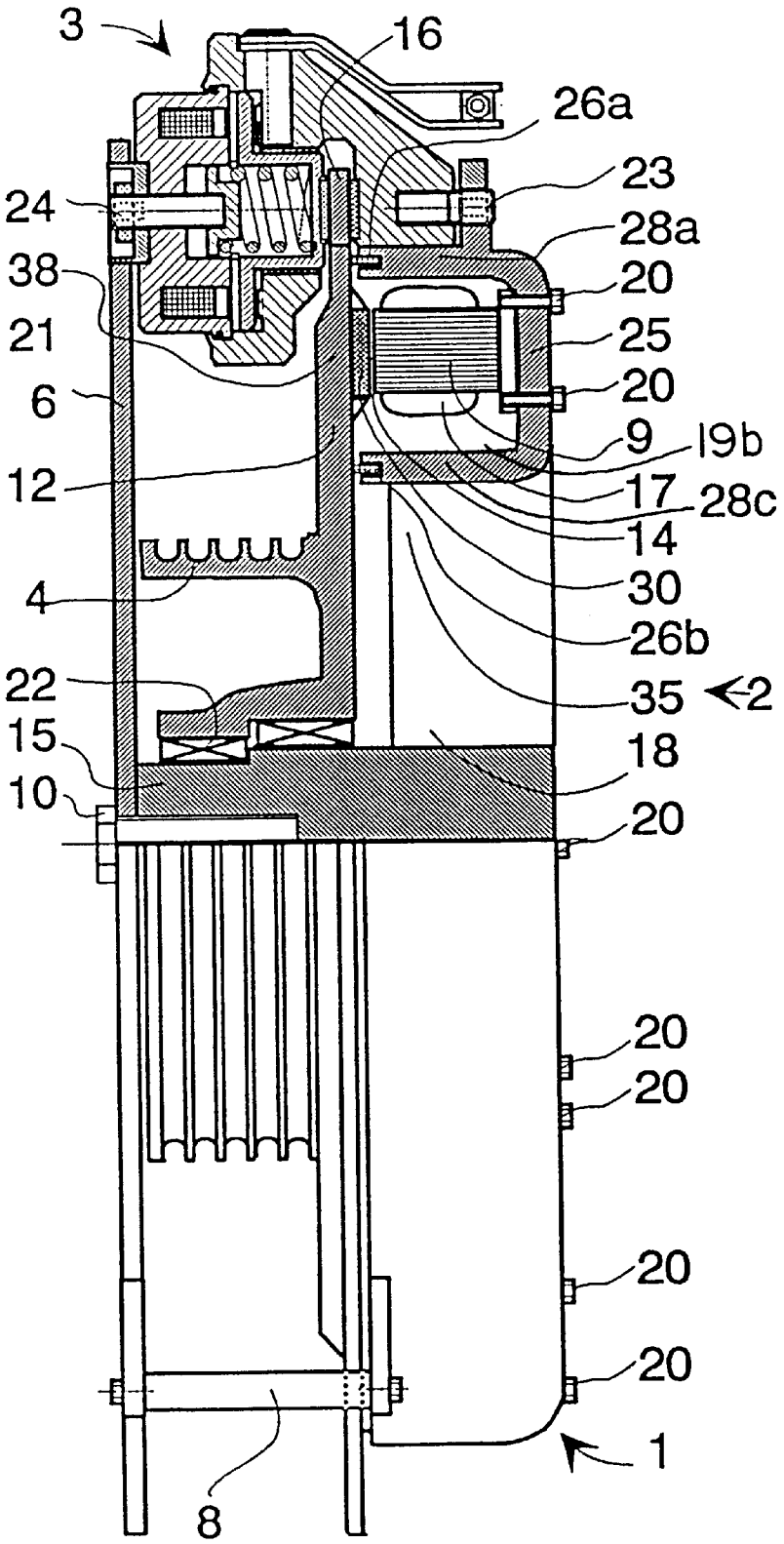

FIG. 1 presents an elevator machinery according to the invention, seen from the direction of the shaft, FIG. 2 presents an elevator machinery with a motor employing a sealing system according to the invention, and FIG. 3 presents another elevator machinery implemented according to the invention.

FIG. 1 shows a front view of a gearless elevator machinery 1 according to the invention, comprising a disc-type elevator motor 2, a disc brake 3 and a traction sheave 4. The elevator ropes 5 are passed around the traction sheave 4. The elevator machinery is held together by fixing elements 8 placed between lugs 7 provided in the stator disc 18 and in the support 6 attached to it. In addition, another fixing element 10 is provided in the central part of the machinery to join the stator disc 18 and the support 6 together. The brake is attached to the support and to the stator disc 18. FIG. 2 shows the machinery as sectioned along fraction line II—II. The motor may be e.g. a synchronous motor or a commutating d.c. motor.

FIG. 2 presents the elevator machinery 1 of FIG. 1 as sectioned along line II—II. The machinery 1 comprises an elevator motor 2, a disc brake 3 with a brake disc 16, and a traction sheave 4. The figure is magnified in the lengthwise direction of the motor shaft 15 to render it more readable. Therefore, in reality the elevator machinery 1 is flatter than its representation in FIG. 2. The main parts of the motor are the rotor 13 and the stator disc 18, along with the supporting plate 6 attached to it and the shaft 15. The rotor comprises a rotor disc 12, with permanent magnets and a traction sheave attached to it.

The permanent magnets 30 are fixed to the surface 36 of the rotor disc 12 in succession so as to form an annular ring. The part of the rotor disc 12 which lies under the permanent magnets 30 acts both as a magnetic circuit 38 and as a supporting structure 37 of the rotor disc 12. The permanent magnets may vary in shape and they can be divided into smaller magnets placed side by side or in succession.

The permanent magnets 30 and the stator 9 are protected against external particles by an annular capsule and an annular sealing placed between the stator and rotor discs. The sealing may be attached either to the stator disc or to the rotor disc. In FIG. 2, the sealing is attached to the stator disc 18. The annular capsule consists of a ringlike cavity 19*a* formed by three walls which leave the cavity open on the side facing the rotor disc 12.

The outer annular wall 28*a* of the cavity 19*a* is directed towards the rotor disc 12 and the inner wall 28*b* is joined with the shaft 15. Between walls 28*a* and 28*b* is a wall 25 directed towards the shaft. If the length of the shaft 15 is extended, the inner wall 28*b* can be thought of as forming part of the shaft 15, and the wall directed towards the shaft as being directly attached to the shaft 15. The stator 9 has a stator core packet of stampings 11 with a winding 17. The stator has an annular shape and is placed near the outer wall 28*a*. If necessary, the stator may also be divided into separate sectors. The stator core packet 11 together with the winding 17 is attached to the cavity wall 25 perpendicular to the shaft by means of fixing elements 20, preferably screws. If desirable, the stator core packet can be attached to any one of the cavity walls.

The outermost annular wall 28*a* of the stator disc 18 is provided with a sealing 26*a* which touches the rotor disc 12, thus closing the cavity 19*a* (capsule), enclosing both the stator 9 and the permanent magnets 30 of the rotor 13. One of the walls of the closed cavity 19*a* is thus formed by the rotor disc 12. The sealing stop face in the rotor disc 12 lies between the brake disc 16 and the circle formed by the permanent magnets 30. The fixing element 27 required for the attachment of the sealing 26*a* is implemented as a groove in that wall 28*a* of the cavity 19*a* in the stator disc 18 which is oriented in the direction of the shaft 15. The sealing 26*a* may be e.g. a felt seal. A seat for the seal may be integrated with the stator disc 18 during manufacture, so the sealing can be effected at a low manufacturing cost. The seal used may be any one of the commonest sliding-contact seal types, such as a felt seal, lap seal or brush seal. It is also possible to use a labyrinth seal and an annular band gathering magnetic dust, either alone or as a combination consisting of a magnetic band and one of the above-mentioned seal types, e.g. a brush seal. Alternatively, the sealing can be placed on the rotor disc, in which case the sealing stop face is on the stator disc. In the case of a labyrinth seal, annular grooves and ridges are formed both in the stator disc and the rotor disc.

The traction sheave 4 is integrated with the rotor disc 12 or it may also be a separate body attached to the disc. The diameter of the traction sheave 4 is smaller than the diameter of the circle formed by the permanent magnets 30 or that of the stator. The rotor disc is provided with a ring-shaped brake disc attached to the rotor as an extension of its top circle. Thus, the brake disc is substantially an immediate extension of the rotor disc, yet with a narrow annular area for a sealing betweeen the rotor bars and the brake disc.

The rotor disc can be advantageously manufactured by integrating the rotor disc, traction sheave and brake disc into a single structure. The disc brake 3 is mounted by means of attachments on either side of the brake disc 16, allowing the brake to float in the lengthwise direction of the shaft 15. The disc brake is floatably mounted by means of detachable brake supporting elements 23 and 24 which attach the disc brake to the stator disc 18 on one side and to the support 6 fixed to the stator disc 18 on the other side. The support 6 and the stator disc 18 are fastened to each other by means of fixing elements 8 placed between the lugs 7 and with another fixing element 10 in the area of the shaft.

The spaces between the rotor disc 12 and the permanent magnets 30 as well as the corner between the stator disc and the permanent magnets are at least partially filled with non-magnetic filler material 33, such as polymerized resin, which is attached to the rotor disc 12 and permanent magnets 30. Magnetic particles as well as ordinary dust may gather in corners, and the purpose of the filler is to ensure that no such corners or recesses appear in the magnetic circuit. It is also possible to cover the magnets with a thin non-magnetic sheet to protect the magnets and to facilitate cleaning. Any kind of particles are easier to remove from surfaces having no corners.

The permanent magnets 30 and the stator 9 are separated by an air gap 14 lying in a plane substantially perpendicular to the shaft 15 of the motor 2.

The stator disc 18 and the shaft 15 are integrated together as a single part, but naturally they can as well be implemented as separate parts joined together. Bearings 22 are provided between the stator disc 18 and the rotor disc 12.

The stator and rotor windings can be protected with a sealing 26*a* according to the invention even in the case of a disc-type motor in which the shaft is attached to the rotor disc 12. In this type of motor, the bearings are placed between the stator disc and the shaft attached to the rotor disc. Still, the things essential to the viability of the invention, i.e. forming the stator space as an annular cavity 19*a* and sealing this cavity with respect to the stator disc by means of a seal, are the same as in the motor design presented in FIG. 2.

The motor in FIG. 3 is identical in structure with the motor in FIG. 2 except that the stator 9 is now placed in a cavity 19*b* having the shape of an annular capsule, formed by two stator disc walls 28*a* and 28*c* directed towards the rotor disc 12 and a wall 25 perpendicular to the shaft between them. One annular seal 26*a* is attached to the outer wall 28*a* of the cavity and the other annular seal 26*b* to its inner wall 28*c* lying closer to the shaft 15. The inner wall is attached to the shaft 15 by means of supporting ribs 35. Instead of supporting ribs it is also possible to use some other kind of support, e.g. an annular plate. The motor structure presented in FIG. 3 is especially suitable for motors with a large diameter.

It is obvious to a person skilled in the art that the embodiments of the invention are not restricted to the examples described above, but that they may instead be varied within the scope of the claims presented below.

We claim:

1. An elevator motor comprising a stator, a shaft and a rotor, in which the stator includes a stator winding mounted on a stator disc and the rotor includes a generally planar rotor disc, wherein the stator disc comprises a troughlike annular cavity defined by walls and open on one side, the open side and at least one of the walls of said cavity being directed towards and almost contacting the generally planar rotor disc, in which cavity the stator winding is mounted, an annular sealing being provided between the rotor disc and the at least one wall directed towards and almost contacting the rotor and surrounding said cavity, said annular sealing serving to isolate the cavity so as to render it a closed space.

2. The elevator motor according to claim 1, wherein said stator disc includes at least one outer annular wall directed towards the rotor disc and an inner annular wall directed towards the rotor disc, and further wherein said sealing is provided at least between the outer wall and the rotor disc.

3. The elevator motor according to claim 2, wherein respective sealings are provided between the outer and inner annular walls and the rotor disc.

4. The elevator motor according to claim 2, wherein said outer and inner annular walls are joined together.

5. The elevator motor according to claim 2, wherein said stator further comprises a third wall joining said inner and outer annular walls.

6. The elevator motor according to claim 2, further comprising a supporting rib connecting said inner annular wall to said shaft.

7. The elevator motor according to claim 2, wherein an edge of said inner annular wall closest to said rotor disc is substantially coplanar with an edge of said outer annular wall closest to said rotor disc.

8. The elevator motor according to claim 1, wherein the annular sealing is attached to that edge of a wall directed towards the rotor disc which lies next to the generally planar rotor disc.

9. The elevator motor according to claim 8, wherein the annular sealing is fastened in an integrated groove in the edge of the wall next to the generally planar rotor disc.

10. The elevator motor according to claim 8, wherein the sealing is one of a felt seal, a brush seal, and a lap seal.

11. The elevator motor according to claim 8, wherein the sealing is a magnetic band seal combined with one of a brush seal, a felt seal, and a lap seal.

12. The elevator motor according to claim 8, wherein the sealing is a magnetic band seal combined with a labyrinth seal.

13. The elevator motor according to claim 1, wherein the annular sealing is attached to the generally planar rotor disc at a location opposite to the edge of a wall directed towards the rotor disc.

14. The elevator motor according to claim 13, wherein the sealing is a magnetic band seal combined with one of a brush seal, a felt seal, and a lap seal.

15. The elevator motor according to claim 13, wherein the sealing is a magnetic band seal combined with a labyrinth seal.

16. The elevator motor according to claim 1, wherein the sealing is a labyrinth seal in which annular labyrinth grooves and ridges are integrated with the rotor disc and with the wall directed towards the generally planar rotor disc.

17. Elevator machinery comprising an elevator motor, a traction sheave and a disc brake, said elevator motor comprising a stator and a rotor, which stator includes a stator winding mounted on a stator disc and which rotor is formed as a generally planar rotor disc, which motor is provided with a bearing between the stator and the rotor, wherein the rotor includes permanent magnets on one side of the rotor disc, the magnets forming a ring-shaped circle, the traction sheave is attached to the side of the generally planar rotor disc opposite to the side having said permanent magnets, the disc brake includes a ring-shaped brake disc provided at an outermost region of the rotor disc, the stator disc includes a troughlike cavity formed by at least one outer annular wall directed towards the rotor disc and an inner wall directed towards the rotor disc, and a sealing is provided between the outer wall and the rotor disc, which sealing is pressed against the surface of the generally planar rotor disc and closes the cavity so as to render it a closed space, in which cavity are placed both the stator winding and the permanent magnets, a diameter of said sealing measured where said sealing presses against said generally planar rotor disc being greater than a diameter of said traction sheave.

18. The elevator machinery according to claim 17, wherein said brake disc constitutes a planar extension of the generally planar rotor disc, a plane of said disc brake being parallel to said generally planar rotor disc.

19. The elevator machinery according to claim 18, wherein said brake disc is integral with said rotor disc.

20. The elevator machinery according to claim 17, wherein said elevator motor further includes a shaft integrated with said stator disc so as to form a single part, said bearing being placed between said rotor and said shaft; and said machinery further comprises a supporting plate connected to said stator disc, said disc brake being mounted between said supporting plate and said stator disc.

21. The elevator machinery according to claim 17, wherein said stator further includes an inner wall extending toward said rotor disc, said inner wall defining an inner boundary of said cavity.

22. An elevator motor, comprising:

a rotor fastened directly to a generally planar rotor disc;

a stator fastened directly to a stator disc having at least one wall extending toward said rotor disc so as to form a generally annular cavity, said stator including at least one stator winding located within said cavity;

bearings between said rotor disc and said stator disc; and a traction sheave joined to and extending from said rotor disc in a longitudinal direction which is perpendicular to said rotor disc and away from said stator, wherein an airgap formed between said rotor and stator lies in a plane substantially perpendicular to said longitudinal direction, and said rotor disc, stator disc, bearings and traction sheave lie within a single plane substantially parallel to said airgap.

23. The elevator motor according to claim 22, wherein said traction sheave extends from said rotor disc toward said supporting plate, and further wherein the diameter of said traction sheave is smaller than a diameter of said wall.

24. The elevator motor according to claim 23, wherein said supporting plate covers an area greater than an area defined by a cross section of said traction sheave.

25. The elevator motor according to claim 22, wherein said stator further includes an inner wall extending toward said rotor disc, said inner wall defining an inner boundary of said generally annular cavity.

26. The elevator motor according to claim 22, further comprising a supporting plate fixedly positioned relative to said stator, said supporting plate being located on an opposite side of said rotor disc than said stator winding.

27. The elevator motor according to claim 22, wherein said bearings are offset in a direction parallel to said airgap.

28. The elevator motor according to claim 22, further comprising fixing elements for fastening said stator directly to said stator disc.

29. An elevator motor, comprising:

a rotor including a generally planar rotor disc;

a stator including at least one wall extending toward said rotor disc so as to form a generally annular cavity, said stator further including at least one stator winding located within said cavity;

bearings between said rotor and said stator;

a traction sheave joined to said rotor disc;

a supporting plate fixedly positioned relative to said stator, said supporting plate being located on an opposite side of said rotor disc than said stator winding; and a seal between said wall and said rotor disc.

30. The elevator motor according to claim 29, wherein said traction sheave extends from said rotor disc toward said supporting plate, and further wherein the diameter of said traction sheave is smaller than a diameter of said wall.

31. The elevator motor according to claim 30, wherein said traction sheave is exclusively on the side of said rotor disc which is next to said supporting plate.

32. The elevator motor according to claim 29, wherein said stator further includes an inner wall extending toward said rotor disc, said inner wall defining an inner boundary of said generally annular cavity.

33. The elevator motor according to claim 32, further comprising a second sealing between said inner wall and said rotor disc.

34. The elevator motor according to claim 32, wherein said traction sheave extends from said rotor disc toward said supporting plate, and further wherein the diameter of said traction sheave is smaller than a diameter of said inner wall.

35. An elevator motor, comprising:

a rotor including a generally planar rotor disc:

a stator including at least one wall extending toward said rotor disc so as to form a generally annular cavity, said stator further including at least one stator winding located within said cavity;

bearings between said rotor and said stator;

a traction sheave joined to said rotor disc; and a supporting plate fixedly positioned relative to said stator, said supporting plate being located on an opposite side of said rotor disc than said stator winding, wherein said supporting plate covers an area greater than the area inside said wall.

36. The elevator motor according to claim 35, wherein said supporting plate is joined to said stator at locations outside a perimeter of said wall.

37. An elevator motor, comprising:

a rotor including a generally planar rotor disc;

a stator including at least one wall extending toward said rotor disc so as to form a generally annular cavity, said stator further including at least one stator winding located within said cavity;

bearings between said rotor and said stator;

a traction sheave joined to said rotor disc;

a supporting plate fixedly positioned relative to said stator, said supporting plate being located on an opposite side of said rotor disc than said stator winding; and a shaft joined to said stator, wherein said supporting plate is joined to said shaft.

38. The elevator motor according to claim 37, wherein said stator further includes an inner wall extending toward said rotor disc, said inner wall being separated from said shaft and defining an inner boundary of said generally annular cavity.

* * * * *